US006926045B2

(12) United States Patent
Miyazaki et al.

(10) Patent No.: US 6,926,045 B2
(45) Date of Patent: Aug. 9, 2005

(54) BINDING DEVICE

(75) Inventors: Tadahiro Miyazaki, Hyogo (JP); Kiyoshi Ogawa, Hyogo (JP)

(73) Assignee: Tyton Company of Japan, Ltd., Tokyo (JP)

( * ) Notice: Subject to any disclaimer, the term of this patent is extended or adjusted under 35 U.S.C. 154(b) by 0 days.

(21) Appl. No.: 10/331,490

(22) Filed: Dec. 31, 2002

(65) Prior Publication Data

US 2003/0136278 A1 Jul. 24, 2003

(30) Foreign Application Priority Data

Jan. 21, 2002 (JP) ..... 2002-011270

(51) Int. Cl.[7] ..... B21F 9/02
(52) U.S. Cl. ..... 140/93.2; 140/123.6; 100/29
(58) Field of Search ..... 100/29, 32, 33 PB; 140/93.2, 123.6; 30/183, 182, 184

(56) References Cited

U.S. PATENT DOCUMENTS

| | | | | | |
|---|---|---|---|---|---|
| 3,712,346 | A | * | 1/1973 | Noorily | 140/123.6 |
| 3,746,055 | A | * | 7/1973 | Farkas et al. | 140/93.2 |
| 5,127,446 | A | * | 7/1992 | Marelin | 140/93.4 |
| 5,832,964 | A | * | 11/1998 | Joshi | 140/123.6 |
| 6,206,053 | B1 | * | 3/2001 | Hillegonds | 140/123.6 |

* cited by examiner

*Primary Examiner*—Derris H. Banks
*Assistant Examiner*—Jimmy Nguyen
(74) *Attorney, Agent, or Firm*—Bacon & Thomas

(57) ABSTRACT

In order to prevent an uncut part from being formed in a band portion protruding from a head portion of a binding band, the binding device of the invention has a tightening function of tightening bound articles around which the binding band is wound, and a cutting away function of, after the bound articles are tightened, cutting away an extra part of the band portion.

8 Claims, 12 Drawing Sheets

BINDING DEVICE

BACKGROUND OF THE INVENTION

1. Field of the Invention

The present invention relates to a binding device, and more particularly to a binding device in which a binding band wound around bound articles can be tightened and then cut.

2. Description of the Prior Art

A binding band 1 shown in FIG. 10 is known as a binding band which is used for binding wire articles such as wire harnesses or other bound articles. The binding band 1 is configured by an integral molded product which is made of a synthetic resin, and in which a head portion 13 is continuously integrated with one end of a band portion 12. A locking protrusion (not shown) is formed on one face of the band portion 12. By contrast, a band insertion hole portion 15 having an engagement pawl 14 is formed in the head portion 13. When, while bending the band portion 12, the other end of the band portion is inserted into the band insertion hole portion 15 from one side as indicated by the arrow a and then pulled out to the other side as indicated by the arrow b, the engagement pawl 14 is engaged in an arbitrary place of the band portion 12 with the locking protrusion, whereby the band portion 12 is inhibited from being pulled back from the band insertion hole portion 15 in the counter insertion direction (the direction counter to the direction of the arrow a). By contrast, when the band portion 12 is operated so as to be pulled out in the direction of the arrow b, the band portion 12 is inserted into the band insertion hole portion 15.

On the other hand, a binding device shown in FIGS. 8 and 9 is known as a device for binding bound articles such as wire harnesses with using the above-mentioned binding band 1 having the band portion 12 and the head portion 13 which comprises the band insertion hole portion 15 that allows the band portion 12 to be inserted thereinto in the direction of the arrow a, and that disables the band portion from being pulled out in the counter insertion direction (the direction counter to the direction of the arrow a).

FIG. 8 is a diagram of main portions showing a use state of the binding device 2, and FIG. 9 is a schematic section view of main portions of the binding device 2.

As shown in FIG. 8 or 9, the binding device 2 is formed into a gun-like shape having a barrel portion 21. A mouthpiece 3 is attached to the tip end of the barrel portion 21. A clamp 4 is placed behind the mouthpiece 3, and a cutting blade 5 is incorporated into the rear side of the mouthpiece 3. The mouthpiece 3 has a slit-like opening 31. The clamp 4 has a stationary piece 41, and a movable piece 42 which is swingable to approach and separate from the stationary piece 41. In the binding device 2, the clamp 4 is retracted by an operation of pulling-in a trigger which is not shown, and is advanced by an operation of returning the trigger to the original position. When the clamp 4 is retracted, the movable piece 42 swings with using a support shaft 43 as the fulcrum in a direction toward the stationary piece 41 to set a clamp mode, and, when the clamp 4 is advanced, the movable piece 42 swings with using the support shaft 43 as the fulcrum in a direction opposite to the stationary piece 41 to set an un-clamp mode. When a situation in which a force required for retracting the clamp 4 is larger than a threshold value occurs, a lever 51 shown in FIG. 9 operates to push up the cutting blade 5, so that the cutting blade 5 is moved to cross the opening 31 of the mouthpiece 3.

As shown in FIG. 8, the band portion 12 of the binding band 1 is wound around bound articles M such as wire harnesses, and then inserted into the band insertion hole portion 15 of the head portion 13. The band portion 12 which is pulled out to the other side of the band insertion hole portion 15 is passed through the opening 31 of the mouthpiece 3, and further passed between the stationary piece 41 and the movable piece 42 of the clamp 4. In the binding device 2, thereafter, the operations of pulling-in and returning the trigger are repeatedly performed. As a result, under the state where the head portion 13 of the binding band 1 is received by a receiving face 32 formed by a flat front end face of the mouthpiece 3, the band portion 12 is pulled out rearward by the clamp 4 from the band insertion hole portion 15 of the head portion 13 each time when the operation of pulling-in the trigger is performed, whereby the bound articles M are tightened by the band portion 12 (the tightening function of the binding device).

FIG. 11A illustratively shows the state where the bound articles M are tightened by the band portion 12 in this way, and FIG. 11B illustratively shows the state where the band portion 12 is cut.

In the operation of pulling-in the trigger after the bound articles M are tightened as shown in FIG. 11A, the force required for retracting the clamp 4 as indicated by the arrow d in FIG. 11B exceeds the threshold value, and therefore the cutting blade 5 is pushed up as indicated by the arrow c in FIG. 11B by the operation of the lever 51 shown in FIG. 9, and crosses the opening 31 of the mouthpiece 3. As a result, the cutting blade 5 cuts the band portion 12 to remove away an extra part 12*a* of the band portion 12 (the cutting away function of the binding device).

In the conventional binding device 2, the cutting blade 5 shown in FIG. 9 has a linear blade edge 52 (hereinafter, the linear blade edge 52 is referred to as "linear blade"). When the bound articles M are bound by the binding band 1 with using the binding device 2 as shown in FIG. 11B and the band portion 12 is cut to remove away the extra part 12*a*, therefore, also a cut end 12*b* of the band portion 12 protruding from the head portion 13 has a linear shape, and an edge is formed in each of the sides of the cut end 12*b* as shown in FIG. 12A.

When an edge is formed in each of the sides of the cut end 12*b* of the band portion 12 protruding from the head portion 13 as shown in FIG. 12A, there is the possibility that the hand or a finger of the worker is caught by the edge and the worker is injured.

In order to eliminate such a danger, it is required to form the cut end of the band portion 12 protruding from the head portion 13, into an arcuate shape. To comply with this requirement, the shape of the blade edge 52 of the cutting blade 5 is changed to an arcuate one as shown in FIG. 13.

FIG. 13 is a diagram showing a cross sectional shape of the mouthpiece 3 in which a cutting blade 5 having an arcuate blade edge 52 is incorporated into the rear side. The shape of the blade edge 52 of the cutting blade 5 in the figure is arcuate so that a place which is nearer to the center portion in the width direction or the widthwise center portion is positioned more backward. In other words, the blade edge 52 of the cutting blade 5 is formed into an arcuate shape which is positioned in the front side in the pulling-out direction (the arrow b) of the band portion 12 from the band insertion hole portion 15 of the head portion 13 of the binding band 1 shown in FIG. 10 (hereinafter, the arcuate blade edge 52 is referred to as "arcuate blade").

In the case where the blade edge 52 of the cutting blade 5 is changed from a linear blade to an arcuate blade as described above, when the bound articles M are bound by the binding band 1 with using the conventional binding device 2 and the band portion 12 is cut to remove away the extra part 12*a* as shown in FIG. 11B, also the cut end 12*b* of the band portion 12 protruding from the head portion 13 has an arcuate shape, and an edge is not formed in the sides of the cut end 12*b* as shown in FIG. 12B, so that the above-mentioned danger is eliminated.

In the conventional binding device, as described with reference to FIG. 8, the head portion 13 of the binding band 1 is received by the receiving face 32 formed by the flat front end face of the mouthpiece 3. When the blade edge 52 of the cutting blade 5 is changed to an arcuate blade such as shown in FIG. 13, therefore, another problem which will be described with reference to FIG. 14 or 15 is produced. FIG. 14 is a diagram showing a cross sectional shape of the mouthpiece 3 in the state where the binding band 1 is placed in a normal position, and FIG. 15 is a diagram showing a cross sectional shape of the mouthpiece 3 in the state where the binding band 1 is not placed in the normal position.

In the state where the head portion 13 of the binding band 1 is received by the widthwise center portion of the flat receiving face 32 of the tip end of the mouthpiece 3, as shown in FIG. 14, the band portion 12 which protrudes from the head portion 13 to be passed through the opening 31 of the mouthpiece 3 is opposed to the widthwise center portion of the blade edge 52 configured by the arcuate blade of the cutting blade 5. When the band portion 12 is cut by the cutting blade 5, therefore, the cut end 12*b* (see FIG. 12) of the band portion 12 is formed into an arcuate shape which is bilaterally symmetrical. However, the formation of the cut end 12*b* (see FIG. 12) of the band portion 12 into a bilaterally symmetrical arcuate shape is performed only when the head portion 13 of the binding band 1 is received by the widthwise center portion of the flat receiving face 32 of the mouthpiece 3. In another state, the cut end 12*b* (see FIG. 12) of the band portion 12 is not formed into a bilaterally symmetrical arcuate shape. In the state where the head portion 13 of the binding band 1 is received by a place which is deviated from the center portion of the flat receiving face 32 of the mouthpiece 3 toward one side as shown in FIG. 15, for example, the band portion 12 which protrudes from the head portion 13 to be passed through the opening 31 of the mouthpiece 3 is opposed to the place which is deviated toward one side from the widthwise center portion of the blade edge 52 of an arcuate blade in the cutting blade 5. When the band portion 12 is cut by the cutting blade 5, therefore, the cut end 12*b* (see FIG. 12) of the band portion 12 is formed into a shape which is bilaterally asymmetrical, and an edge may be produced in one side of the cut end 12*b*. Occasionally, a situation may be caused in which only a part of the band portion 12 is cut by the cutting blade 5 and an uncut part remains in the other part of the band portion 12, so that the band portion 12 is not cut off. In FIGS. 14 and 15, L1 indicates the central axis which passes through the widthwise center portion of the receiving face 32 of the mouthpiece 3, and that of the arcuate blade of the cutting blade 5, and which elongates in parallel with the pulling-out direction, and L2 indicates the central axis which passes through the widthwise center portion of the band portion 12 of the binding band 1. In the case of FIG. 14, the two axes L1 and L2 coincide with each other.

As described above, in the conventional binding device, since the blade edge 52 of the cutting blade 5 is a linear blade, the cut end 12*b* of the band portion 12 of the binding band 1 which binds the bound articles M has a linear shape, and there is the danger that the worker is injured by edges formed in the sides of the cut end 12*b*.

When the blade edge 52 of the cutting blade 5 is changed to an arcuate blade in order to eliminate such a danger, a manual cumbersome work of positioning the head portion 13 of the binding band 1 to the widthwise center portion of the receiving face 32 of the mouthpiece 3 to be received thereby must be conducted because the receiving face 32 of the mouthpiece 3 is formed as a flat face. Consequently, there is a problem in that the efficiency of a binding work in which binding must be performed in many places is largely lowered.

SUMMARY OF THE INVENTION

The invention has been conducted in view of the above-discussed circumstances and problems. It is an object of the invention to provide a binding device in which a countermeasure is taken in the shape of a receiving face of a mouthpiece to enable a head portion of a binding band to be automatically positioned in the widthwise center portion of the receiving face of the mouthpiece by a work of tightening bound articles with the binding band, whereby a situation in which an uncut part is formed in a band portion protruding from the head portion is prevented from occurring.

It is another object of the invention to provide a binding device in which, even when the blade edge of a cutting blade is formed as an arcuate blade and a work of manually positioning a head portion of a binding band to the widthwise center portion of a receiving face of a mouthpiece is not conducted, the head portion is automatically positioned in the widthwise center portion of the receiving face of the mouthpiece and a cut end of a band portion protruding from the head portion is formed into a bilaterally symmetrical arcuate shape, whereby the efficiency of a binding work can be enhanced and the safety of the work can be ensured.

It is a further object of the invention to provide a binding device in which the protrusion length of a band portion protruding from a head portion of a binding band can be correctly set.

The binding device of the invention has: a tightening function of, in a binding band having a band portion and a head portion comprising a band insertion hole portion into which the band portion is insertable, and from which the band portion is disabled to be pulled back in a counter insertion direction, pulling out the band portion from the band insertion hole portion in a pulling-out direction, to tighten bound articles around which the band portion is wound; and a cutting away function of, after the bound articles are tightened, cutting away an extra part of the band portion pulled out from the band insertion hole portion, and the tightening function is performed by, under a state where the head portion is received by a receiving face formed in a front end face of a mouthpiece, causing a clamp mechanism to grasp the extra part of the band portion passed through a slit-like opening of the mouthpiece, and then pulling out the extra part in the pulling-out direction. These conditions are provided in the binding device which has been described with reference to FIG. 8 or 9 or the other figures.

In the invention, the receiving face of the mouthpiece is formed by an inclined face in which a place that is closer to a center portion in the width direction is positioned more forward in the pulling-out direction, and which has slipperiness with respect to the head portion. According to the configuration, when the head portion of the binding band is received by the receiving face of the mouthpiece and the band portion protruding from the head portion is then grasped by the clamp mechanism and pulled out in the pulling-out direction to tighten the bound articles, the head portion is pressed against the receiving face. When the head portion is positioned in the widthwise center portion of the receiving face, therefore, the head portion is pressed in the position against the receiving face. By contrast, when the head portion is deviated from the widthwise center portion of the receiving face toward one side, a centripetal function in which the head portion slips on the receiving face to approach the widthwise center portion of the receiving face is performed. At the timing when the extra part of the band portion protruding from the band insertion hole portion of the head portion is cut off after the bound articles are tightened, therefore, the head position is automatically positioned in the widthwise center portion of the receiving face, and the band portion protruding from the head portion is opposed to the widthwise center portion of the blade edge of the cutting blade so as to be cut thereby. As a result, a situation in which an uncut part is formed in the band portion protruding from the head portion does not occur.

As a preferred embodiment, the binding device of the invention is configured so that the inclined face forming the receiving face is formed into a valley-like shape in which a flat one side region and a flat other side region are equal to each other in opening angle with respect to a central axis that passes the center portion of the receiving face, and that elongates in parallel with the pulling-out direction, the one side region and the other side region being positioned across the central axis. According to the configuration, even in the case where the head portion of the binding band is placed with being deviated toward either of the right and left sides with respect to the central axis of the receiving face, when the bound articles are tightened and the head portion is pressed against the receiving face, the head portion is positioned in the same state to the widthwise center portion of the receiving face by the above-mentioned centripetal function of the receiving face.

As another preferred embodiment, the binding device of the invention is configured so that the cutting away function is exerted by a cutting blade which is moved in a rear side of the mouthpiece to cross the slit-like opening, and a blade edge of the cutting blade is formed into an arcuate shape in which a place that is closer to a center portion in the width direction is positioned more forward in the pulling-out direction. According to the configuration, because of cooperation of the centripetal function exerted by the receiving face and the arcuate blade of the edge of the cutting blade, the cut end of the band portion protruding from the head portion is formed into a bilaterally symmetrical arcuate shape, so that no edge is formed in both the ends. As a result, the binding work can be safely performed.

As a further preferred embodiment, the binding device of the invention is configured so that a distance between an end face of the head portion which is received by the receiving face and the cut end of the band portion is defined by a distance between a place for receiving the head portion in the receiving face and the blade edge of the cutting blade. According to the configuration, the distance between the place for receiving the head portion in the receiving face and the blade edge of the cutting blade is correctly reflected to that between the end face of the head portion and the cut end of the band portion.

As a still further preferred embodiment, the binding device of the invention is configured so that a recess which receives the head portion to position the head portion in the widthwise center portion of the receiving face is formed to extend in both the one side region and the other side region of the receiving face, and a bottom face of the recess is formed as an auxiliary receiving face which receives the head portion. In this case, preferably, a distance between the end face of the head portion which is received by the auxiliary receiving face and the cut end of the band portion is defined by a distance between a place for receiving the head portion in the auxiliary receiving face and the blade edge of the cutting blade. According to the configuration, the distance between the place for receiving the head portion in the auxiliary receiving face and the blade edge of the cutting blade is correctly reflected to that between the end face of the head portion and the cut end of the band portion. In the case where the head portion has a size which allows the portion to enter the recess, the auxiliary receiving face is useful for receiving the head portion to position the head portion to the widthwise center portion of the receiving face or the auxiliary receiving face. In the case where the head portion has a size by which the portion cannot enter the recess, the receiving face surrounding the recess is useful for receiving the head portion to position the head portion to the widthwise center portion of the receiving face.

DETAILED DESCRIPTION OF THE PREFERRED EMBODIMENTS

A first embodiment of the invention will be described with reference to FIGS. 1 to 4. In the description of the embodiment, also FIGS. 8 to 12 are referred as required.

Figure 1:
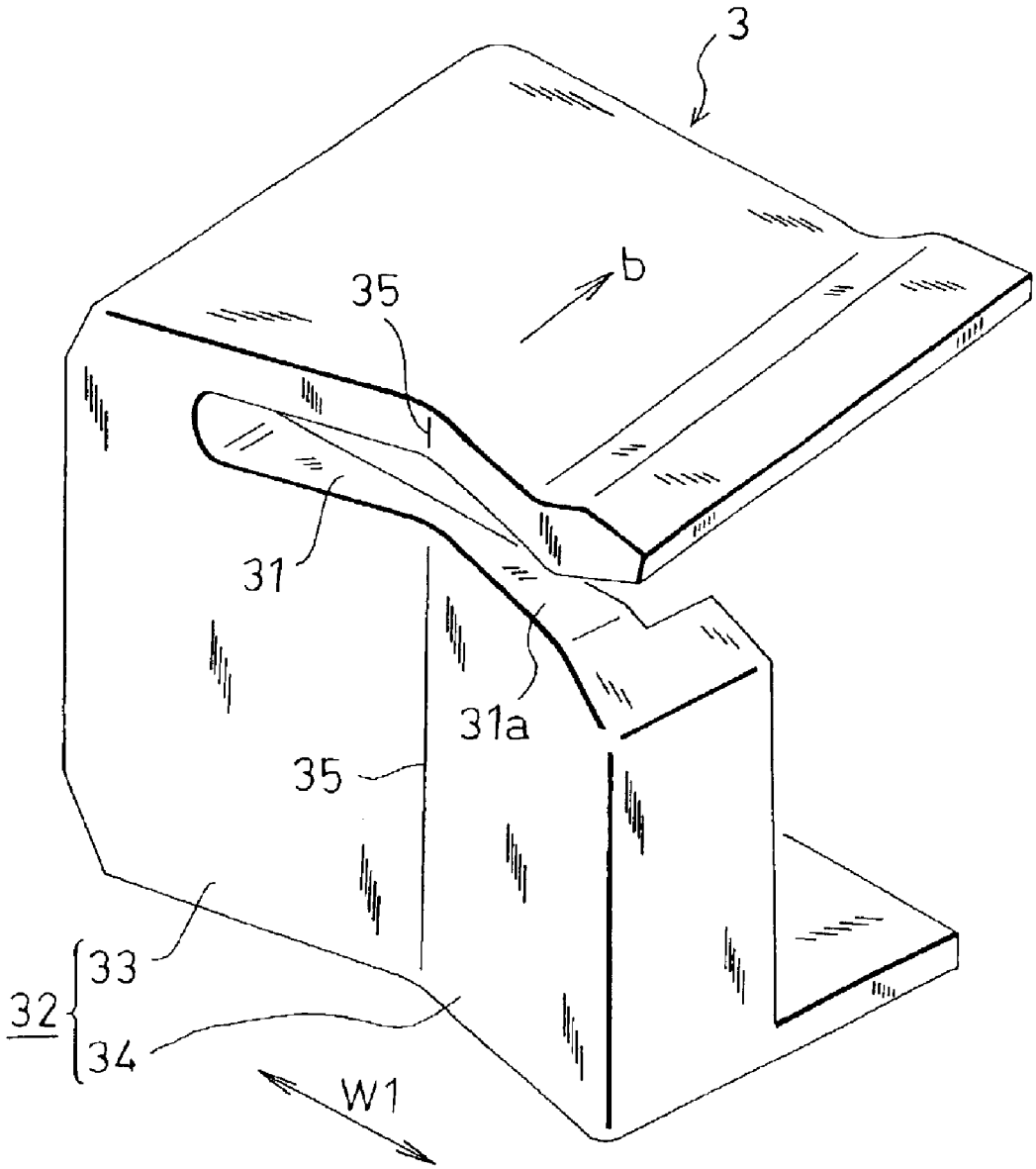
FIG. 1 is a schematic perspective view of a mouthpiece which is useful in the binding device of the invention.
Figure 2:
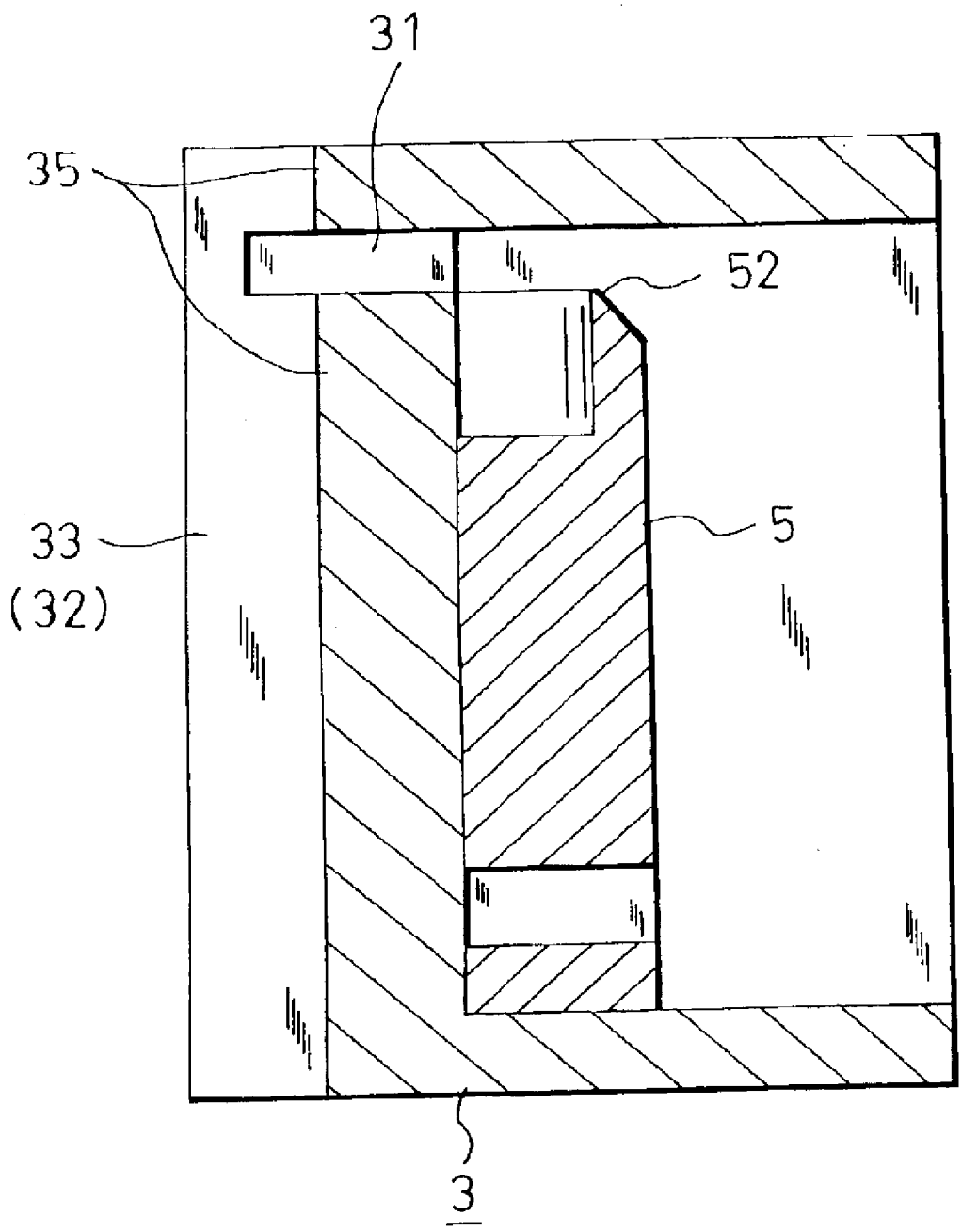
FIG. 2 is a longitudinal section view of a state where a cutting blade is attached to the mouthpiece.
Figure 7:
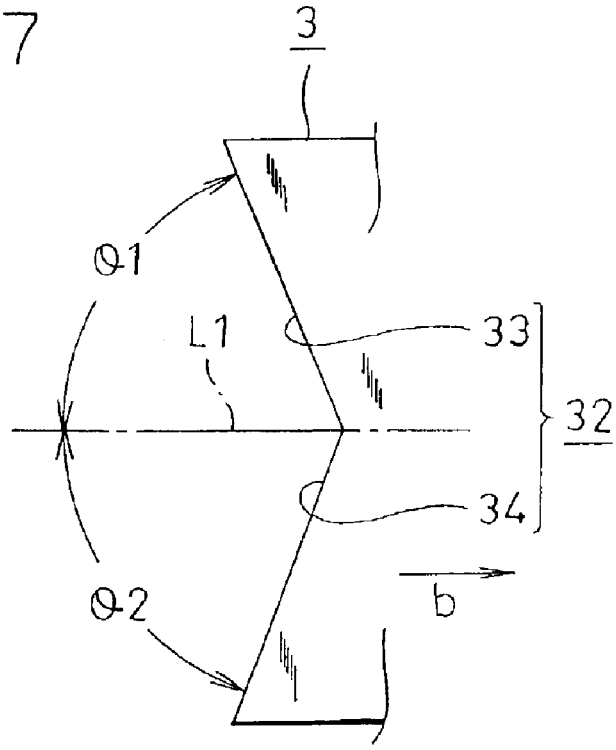
FIG. 7 is a diagram showing opening angles of inclined faces of a valley-like shape which form a receiving face.

A mouthpiece 3 of FIG. 1 is used in place of the mouthpiece 3 of the binding device 2 which has been described with reference to FIGS. 8 and 9. In the mouthpiece 3 of FIG. 1, the whole front end face is formed as a receiving face 32, and the receiving face 32 shows excellent slipperiness with respect to the head portion 13 of the binding band 1 shown in FIG. 10. The slipperiness of the receiving face 32 can be enhanced by adequately selecting the material of the mouthpiece 3 or forming a plated layer on the receiving face 32. The receiving face 32 of the mouthpiece 3 in the illustrated example is laterally divided into two sections or a flat one side region 33 and a flat other side region 34. The regions 33 and 34 form a valley-like inclined face. The border 35 between the regions 33 and 34 is positioned in a widthwise center portion of the receiving face 32. Therefore, the receiving face 32 is formed by an inclined face in which a place that is closer to the center portion in the width direction W1 is positioned more rearward. In other words, in the valley-like inclined face forming the receiving face 32, as a place is closer to the widthwise center portion, the place is positioned more forward in the pulling-out direction (the arrow b, see FIG. 10) along which, in the case where bound articles are bound by the binding band 1 in the manner that has been described with reference to FIG. 8, the band portion 12 passed through the band insertion hole portion 15 of the head portion 13 of the binding band 1 received by the receiving face 32 is pulled out from the band insertion hole portion 15. As shown in FIG. 7, in the valley-like inclined face forming the receiving face 32, the opening angles θ1 and θ2 of the flat one side region 33 and the flat other side region 34 which are positioned across the central axis L1 that passes the center portion of the receiving face, and that elongates in parallel with the pulling-out direction b are equal to each other.

The mouthpiece 3 comprising the receiving face 32 has the slit-like opening 31 which laterally elongates. A cutting blade 5 is placed on the rear side of the mouthpiece so as to be vertically slidable. As illustratively shown in FIG. 3 or 4, the blade edge 52 of the cutting blade 5 is formed as an arcuate blade. Specifically, the blade edge 52 is formed into an arcuate shape in which a place that is closer to a center portion in the width direction is positioned more forward in the pulling-out direction b. In the opening 31, an end of the one side is opened so that an intermediate part of the band portion 12 of the binding band 1 can be fitted through the open end 31*a* into the opening 31 to be passed therethrough.

Figure 9:
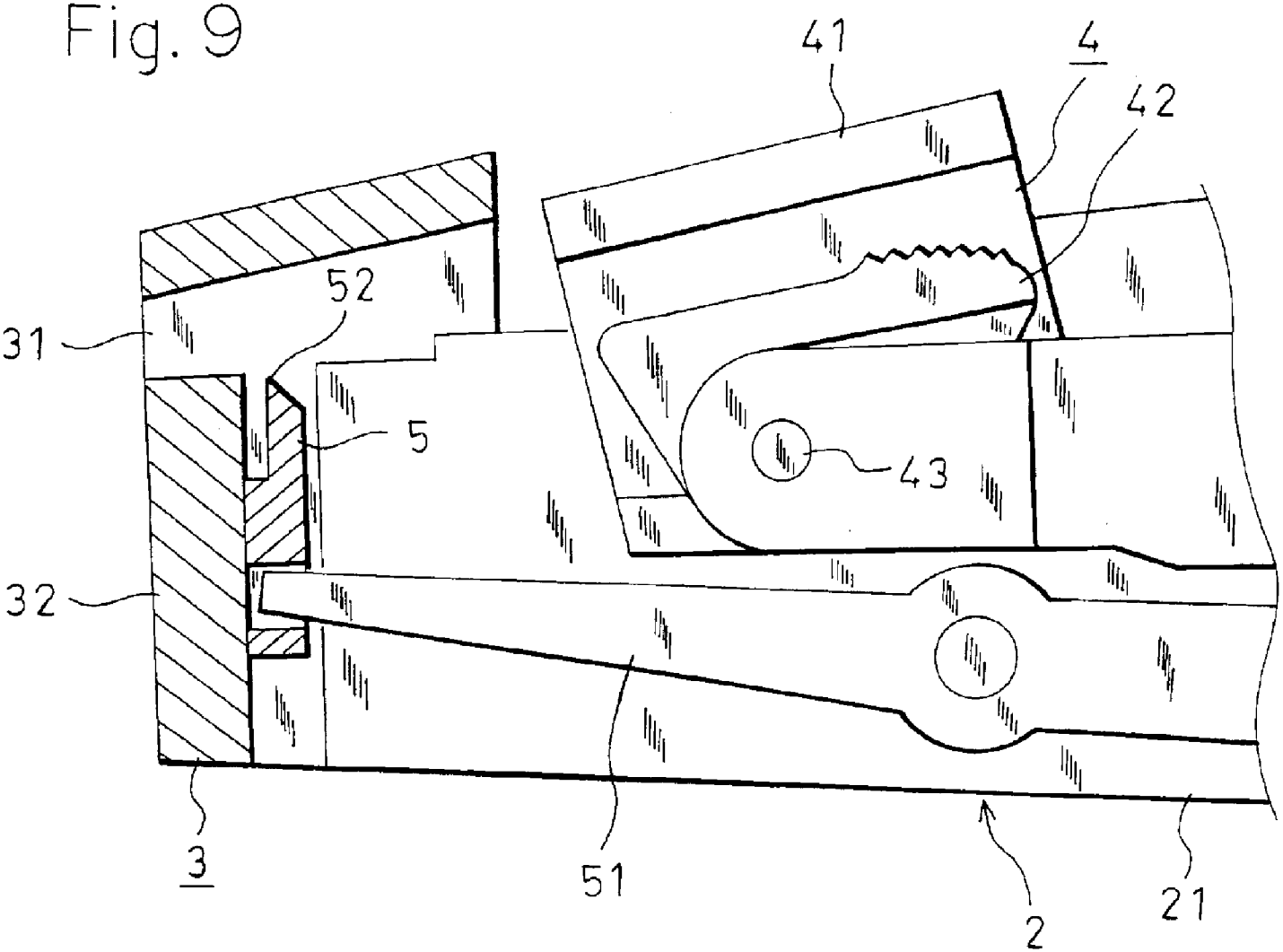
FIG. 9 is a schematic section view of main portions of the binding device.
Figure 10:
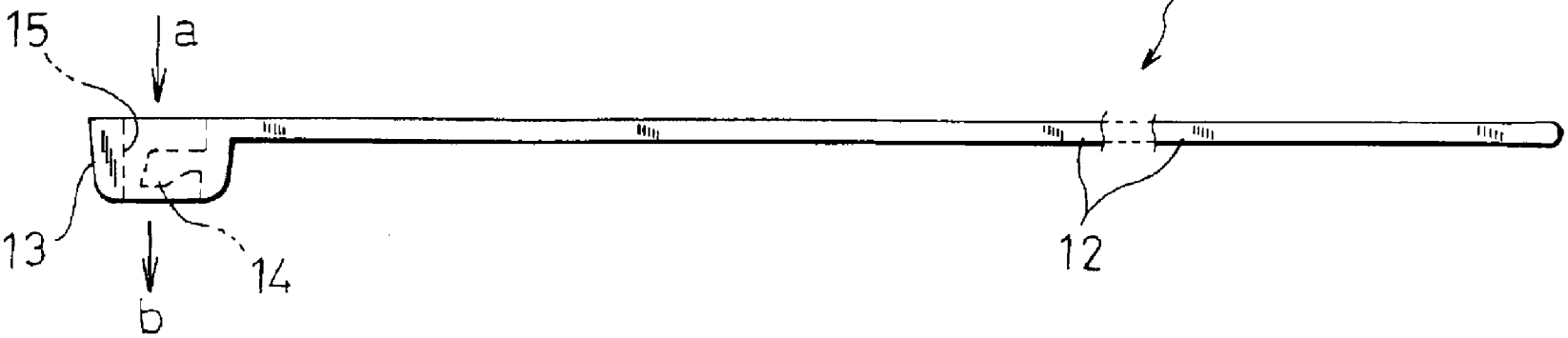
FIG. 10 is a side view exemplarily showing a binding band.

In place of the mouthpiece 3 shown in FIG. 9, the mouthpiece 3 is attached to the barrel portion 21 of the binding device 2 by adequate means such as screw fastening. The lever 51 shown in FIG. 9 is coupled to the cutting blade 5 shown in FIG. 2, and the cutting blade 5 can be vertically slid by operating the lever 51.

Figure 8:
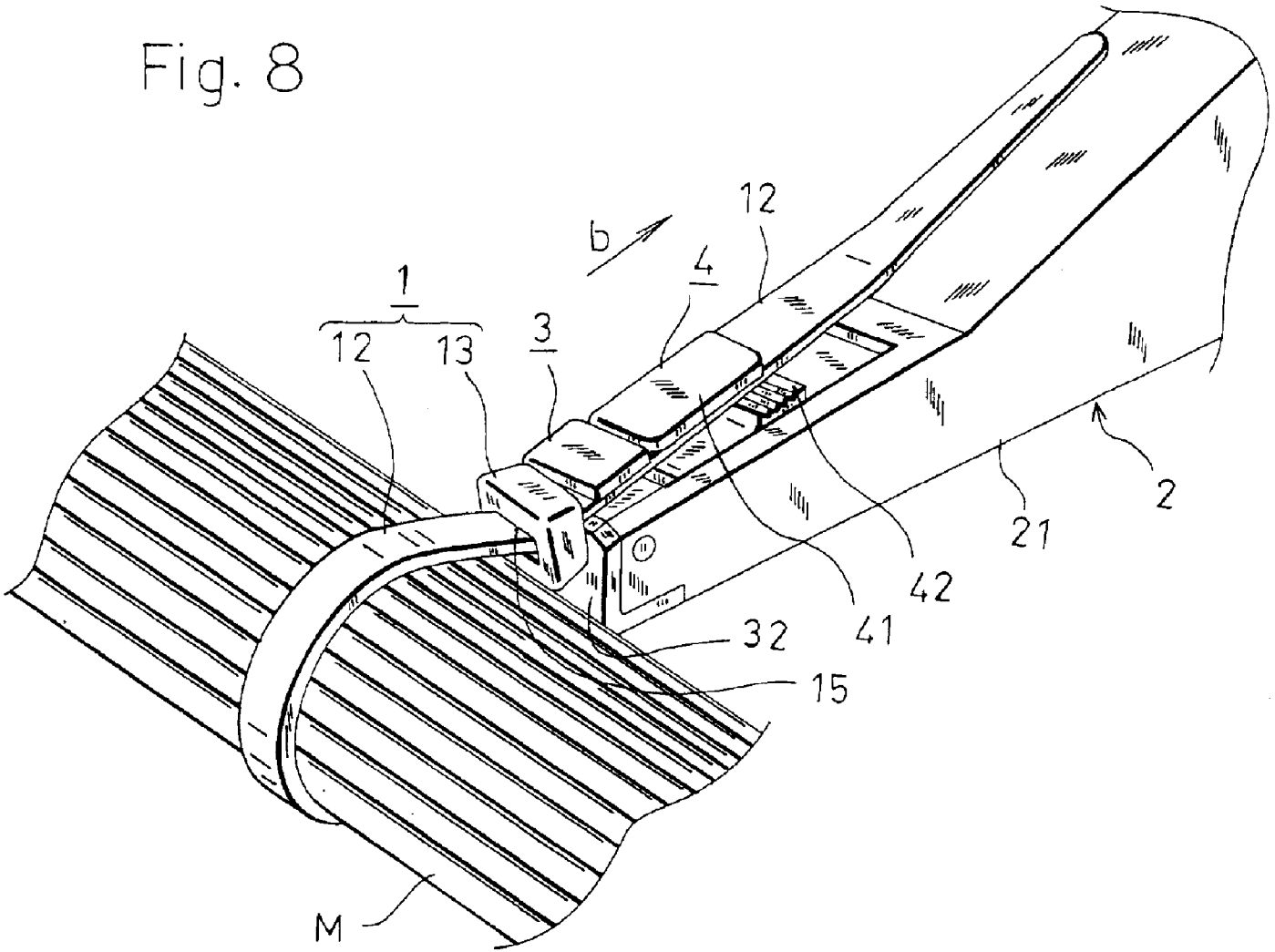
FIG. 8 is a diagram of main portions showing a use state of a binding device.

In the binding device 2 of the embodiment also, as described in the beginning with reference to FIG. 8 or 9, the clamp 4 is placed behind the mouthpiece 3, and the clamp 4 has the stationary piece 41, and the movable piece 42 which is swingable to approach and separate from the stationary piece 41. The clamp 4 is retracted by an operation of pulling-in the trigger which is not shown, and is advanced by an operation of returning the trigger to the original position. When the clamp 4 is retracted, the movable piece 42 swings with using the support shaft 43 as the fulcrum in a direction toward the stationary piece 41 to set a clamp mode, and, when the clamp 4 is advanced, the movable piece 42 swings with using the support shaft 43 as the fulcrum in a direction opposite to the stationary piece 41 to set an unclamp mode. When a situation in which a force required for retracting the clamp 4 is larger than the threshold value occurs, the lever 51 shown in FIG. 9 operates to push up the cutting blade 5, so that the cutting blade 5 is moved to cross the opening 31 of the mouthpiece 3.

Figure 3:
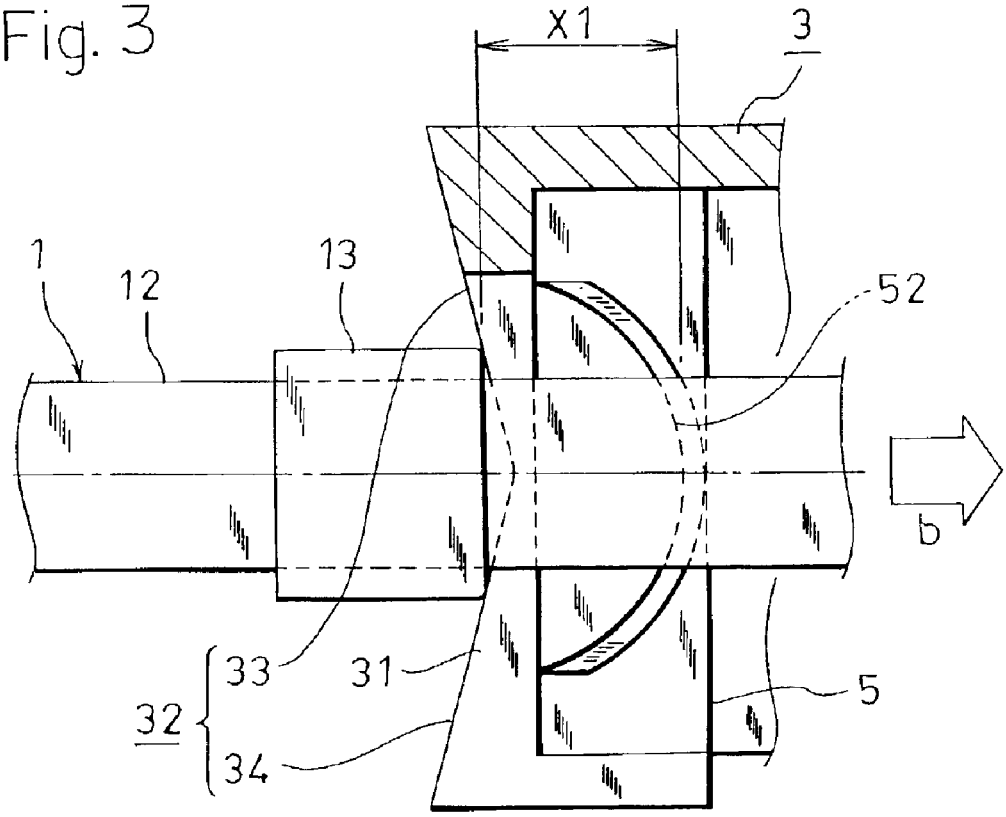
FIG. 3 is a diagram illustrating the function of a binding device of a first embodiment in which the mouthpiece 3 of FIG. 1 is used.
Figure 11A:
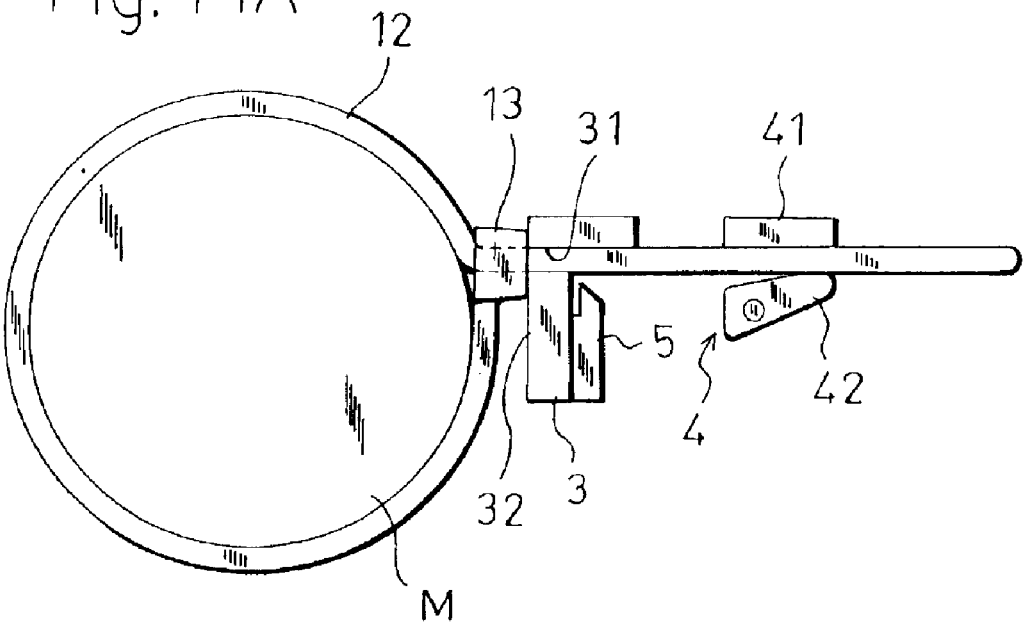
FIG. 11A is a diagram of a state where bound articles M are tightened.
Figure 11B:
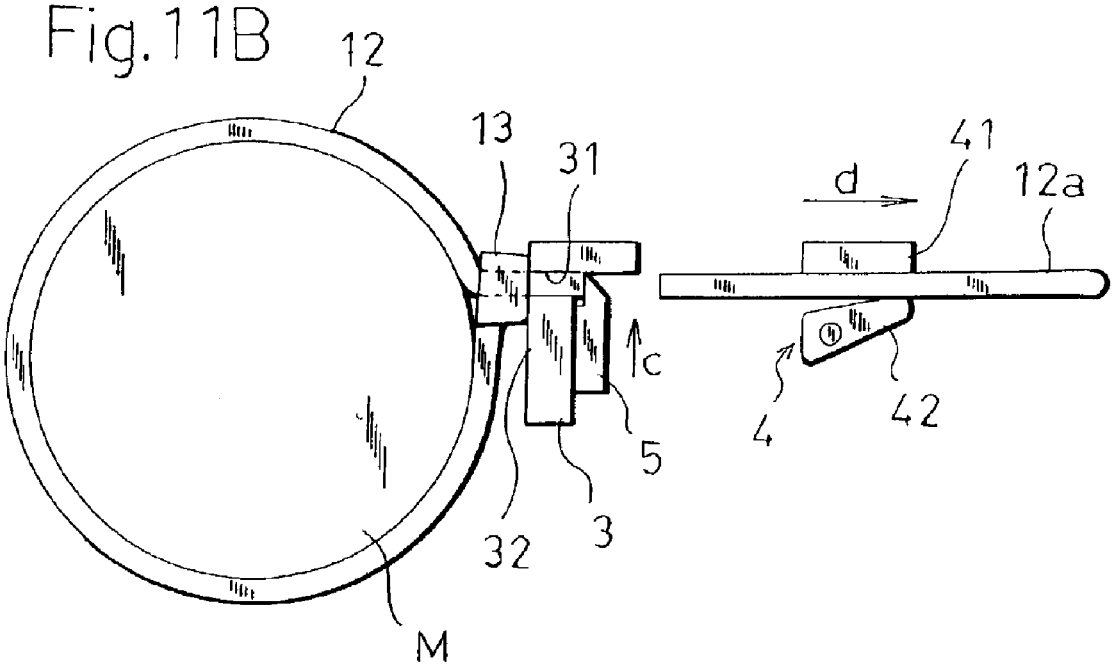
FIG. 11B is a diagram of a state where a band portion is cut.
Figure 12A:
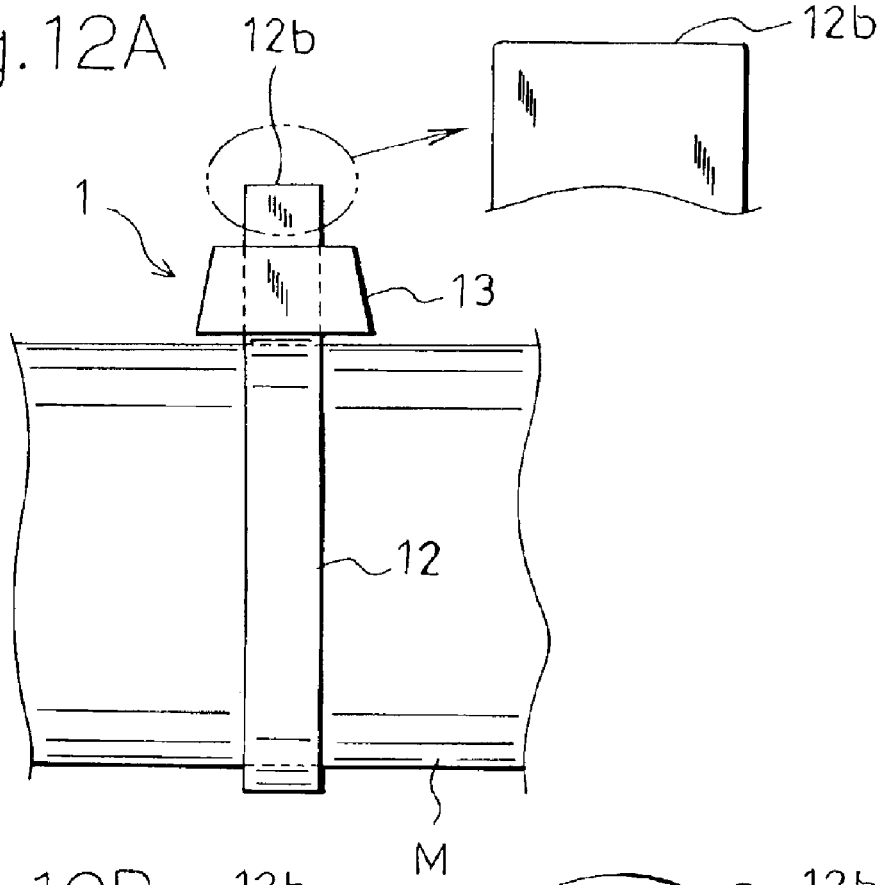
FIG. 12A is a diagram showing the shape of a cut end of the band portion in the case where a linear blade is used.
Figure 12B:
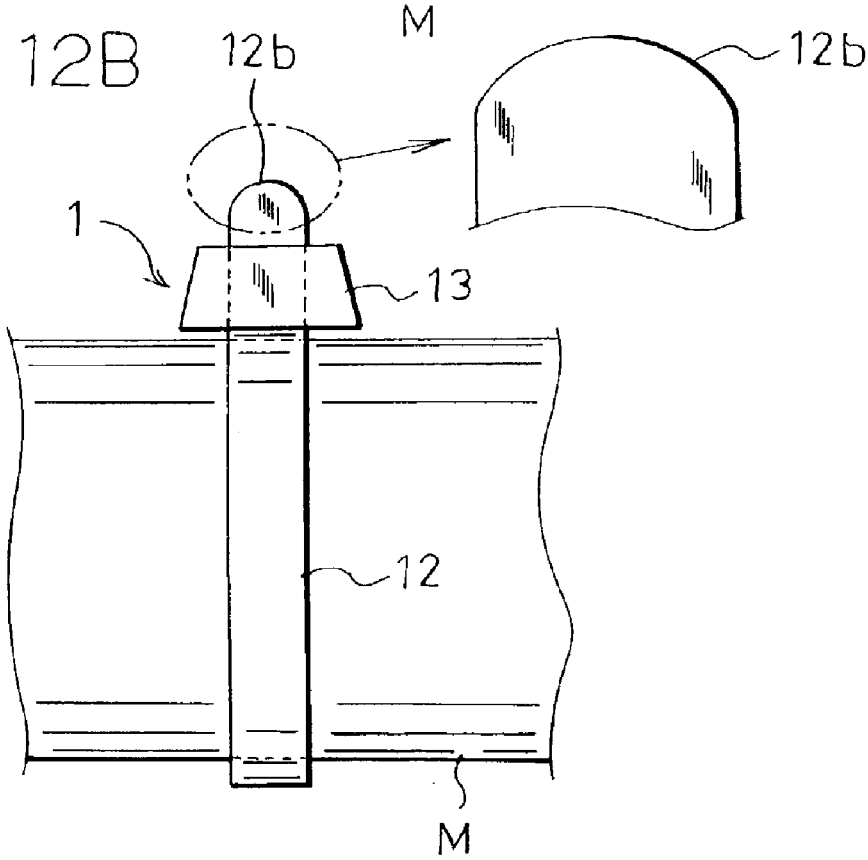
FIG. 12B is a diagram showing the shape of a cut end of the band portion in the case where an arcuate blade is used.
Figure 13:
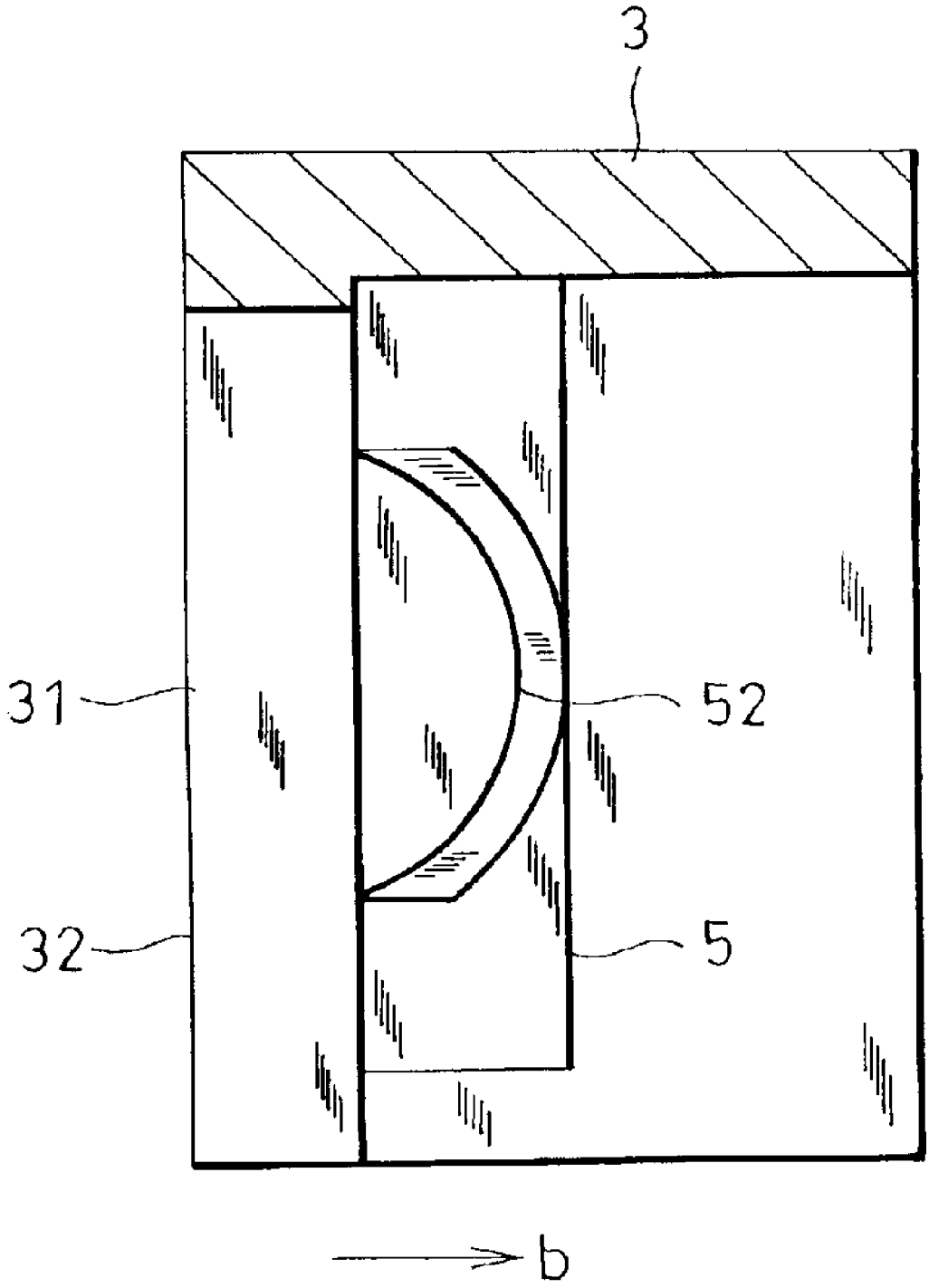
FIG. 13 is a diagram showing a cross sectional shape of a mouthpiece in which a cutting blade having an arcuate blade edge is incorporated into the rear side.
Figure 14:
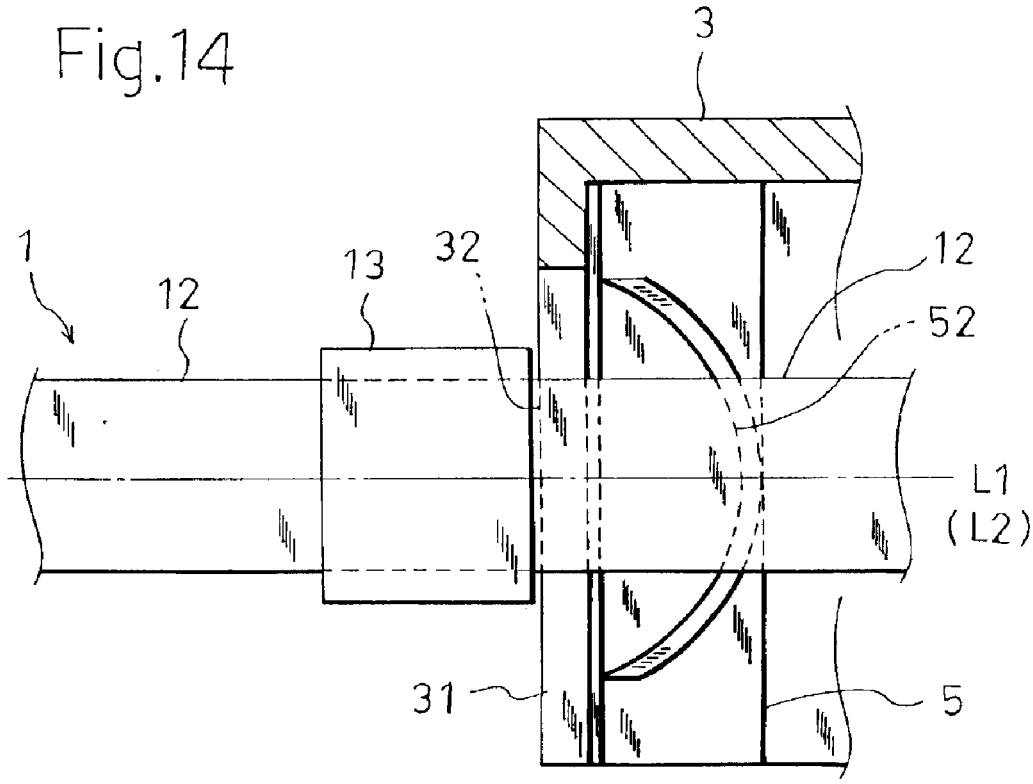
FIG. 14 is a diagram showing a cross sectional shape of the mouthpiece in the state where a binding band is placed in a normal position.
Figure 15:
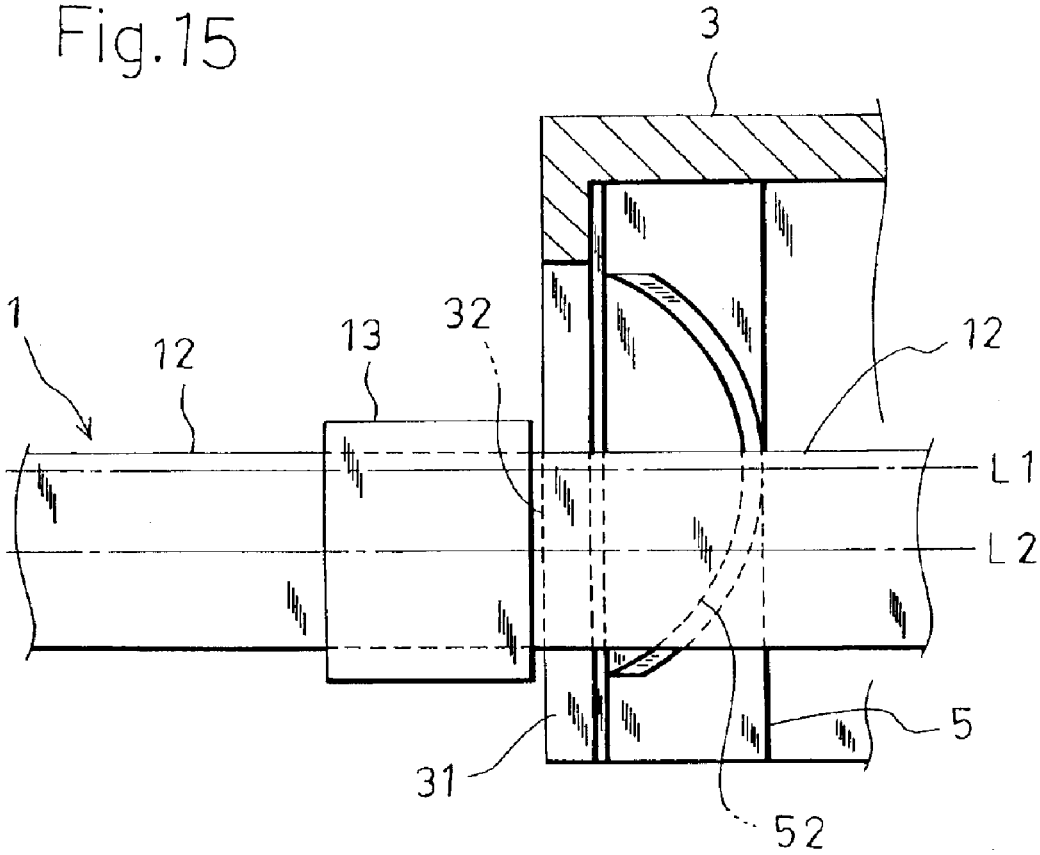
FIG. 15 is a diagram showing a cross sectional shape of the mouthpiece in the state where the binding band is not placed in the normal position.

As shown in FIG. 8, the band portion 12 of the binding band 1 is wound around the bound articles M such as wire harnesses, and then inserted into the band insertion hole portion 15 of the head portion 13. The band portion 12 which is pulled out to the other side of the band insertion hole portion 15 is passed through the opening 31 of the mouthpiece 3, and further passed between the stationary piece 41 and the movable piece 42 of the clamp 4. In the binding device 2, thereafter, the operations of pulling-in and returning the trigger are repeatedly performed. As a result, under the state where the head portion 13 of the binding band 1 is received by the receiving face 32 of the mouthpiece 3, the band portion 12 is pulled back by the clamp 4 from the band insertion hole portion 15 of the head portion 13 each time when the operation of pulling-in the trigger is performed, whereby the bound articles M are tightened by the band portion 12 to exert the tightening function. In the operation of pulling-in the trigger after the bound articles M are tightened as shown in FIG. 11A, the force required for retracting the clamp 4 as indicated by the arrow d in FIG. 11B exceeds the threshold value, and therefore the cutting blade 5 is pushed up as indicated by the arrow c in FIG. 11B by the operation of the lever 51 shown in FIG. 9, and crosses the opening 31 of the mouthpiece 3. As a result, the cutting blade 5 cuts the band portion 12 to remove away the extra part 12*a* of the band portion 12 to exert the cutting away function. Since the blade edge 52 of the cutting blade 5 is an arcuate blade as shown in FIG. 3, also the cut end 12*b* of the band portion 12 protruding from the head portion 13 is formed into an arcuate shape as shown in FIG. 12B, and an edge is not formed in the sides of the cut end 12*b*, so that the danger that the worker is injured is eliminated.

Figure 4:
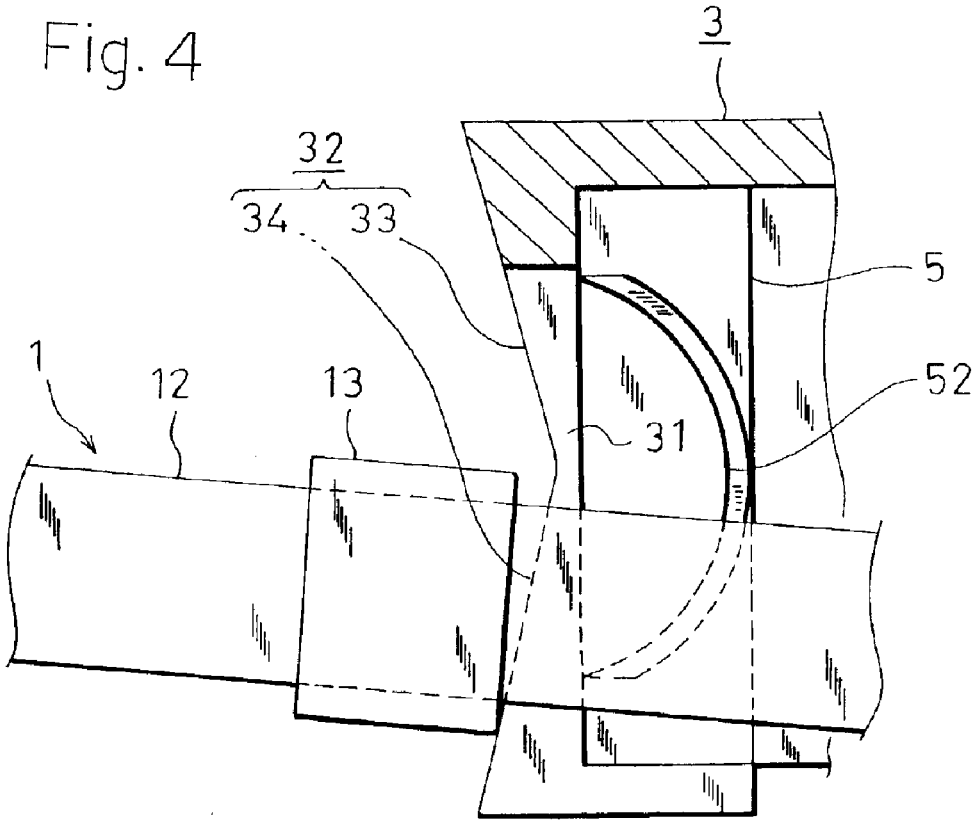
FIG. 4 is a diagram illustrating the function of the binding device of the first embodiment in which the mouthpiece 3 of FIG. 1 is used, in another state.

In the binding device 2 of the embodiment, the receiving face 32 of the mouthpiece 3 is formed by the inclined face in which a place that is closer to the center portion in the width direction W1 is positioned more forward in the pulling-out direction b, and which has slipperiness with respect to the head portion 13 of the binding band 1. Even when, in the initial state in which the band portion 12 of the binding band 1 that is wound around the bound articles M and then passed through the band insertion hole portion 15 of the head portion 13 is passed through the opening 31 of the mouthpiece 3, the head portion 13 is deviated for example toward one side of the receiving face 32 as shown in FIG. 4, consequently, the centripetal function in which the head portion 13 slips on the receiving face 32 to approach the widthwise center portion of the receiving face 32 is exerted by causing the head portion 13 of the binding band 1 to be received by the receiving face 32, then causing the clamp mechanism 4 shown in FIG. 8 to grasp the band portion 12 protruding from the head portion 13, and then pulling out the band portion in the pulling-out direction b to tighten the bound articles M. At the timing when the extra part of the band portion 12 protruding from the head portion 13 is cut off after the bound articles M are tightened, therefore, the head position 13 is automatically positioned in the widthwise center portion of the receiving face 32 as shown in FIG. 3, and the band portion 12 protruding from the head portion 13 is opposed to the widthwise center portion of the blade edge 52 of the cutting blade 5 so as to be cut by the widthwise center portion of the blade edge 52. When the head portion 13 is already positioned in the widthwise center portion of the receiving face 32 as shown in FIG. 3 in the initial state in which the band portion 12 is passed through the opening 31 of the mouthpiece 3, the head portion 13 is pressed in that position against the receiving face 32, and hence also the band portion 12 protruding from the head portion 13 is opposed to the widthwise center portion of the blade edge 52 of the cutting blade 5 and cut by the widthwise center portion of the blade edge 52.

In the embodiment, the opening angles θ1 and θ2 of the right and left flat side regions 33 and 34 which are positioned across the central axis L1 are equal to each other. Even in the case where, in the initial state, the head portion 13 of the binding band 1 is placed with being deviated toward either of the right and left sides about the central axis L1 of the receiving face 32, when the bound articles M are tightened and the head portion 13 is pressed against the receiving face 32, therefore, the head portion 13 is positioned in the same state to the widthwise center portion of the receiving face 32 by the centripetal function of the receiving face 32. As a result, the embodiment has an advantage that, in the case where the binding work is conducted in many places, the cut end of the band portion 12 of the binding band 1 is finished into the same shape in all of the places.

Figure 5:
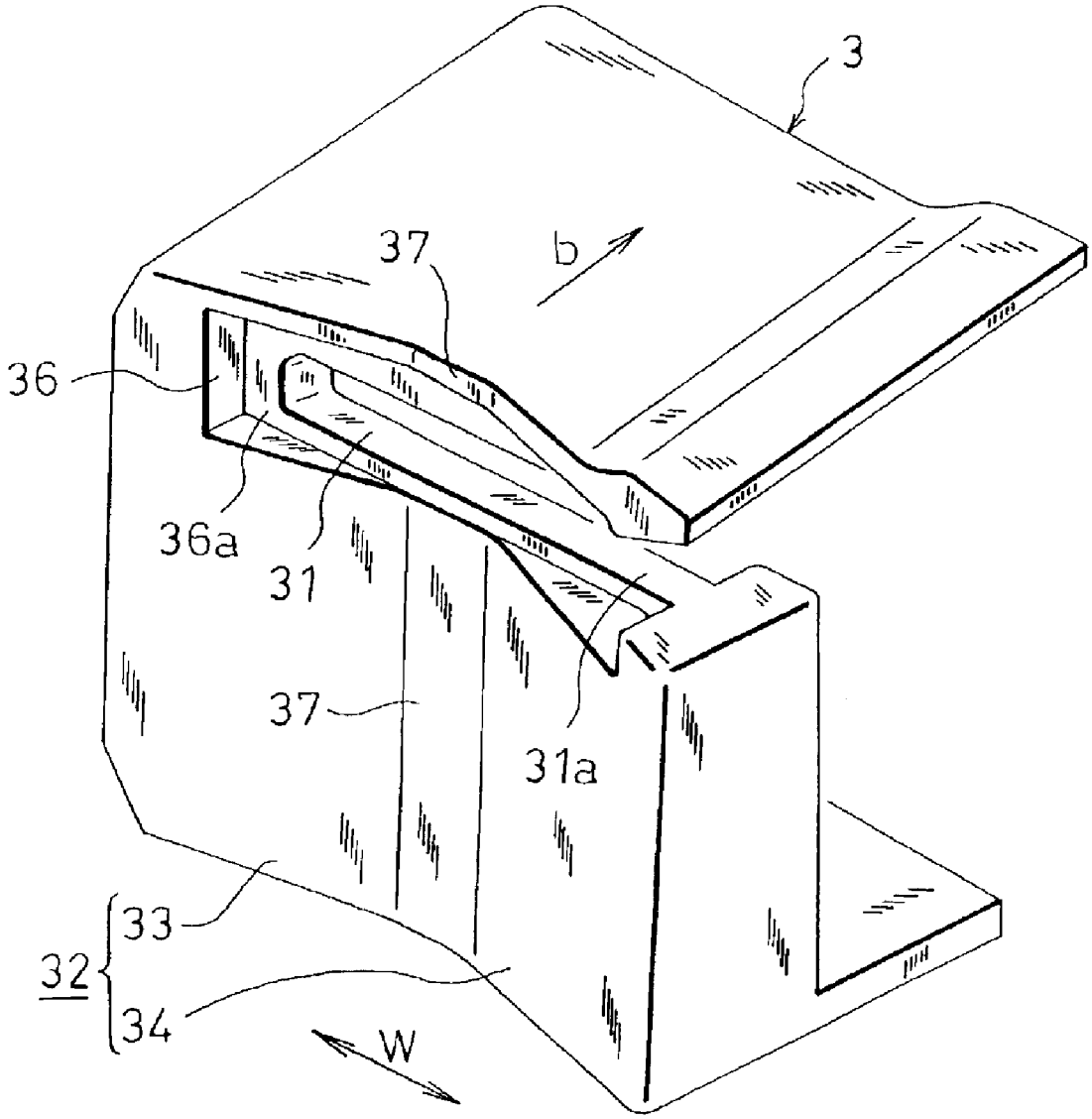
FIG. 5 is a schematic perspective view of another mouthpiece which is useful in the binding device of the invention.
Figure 6:
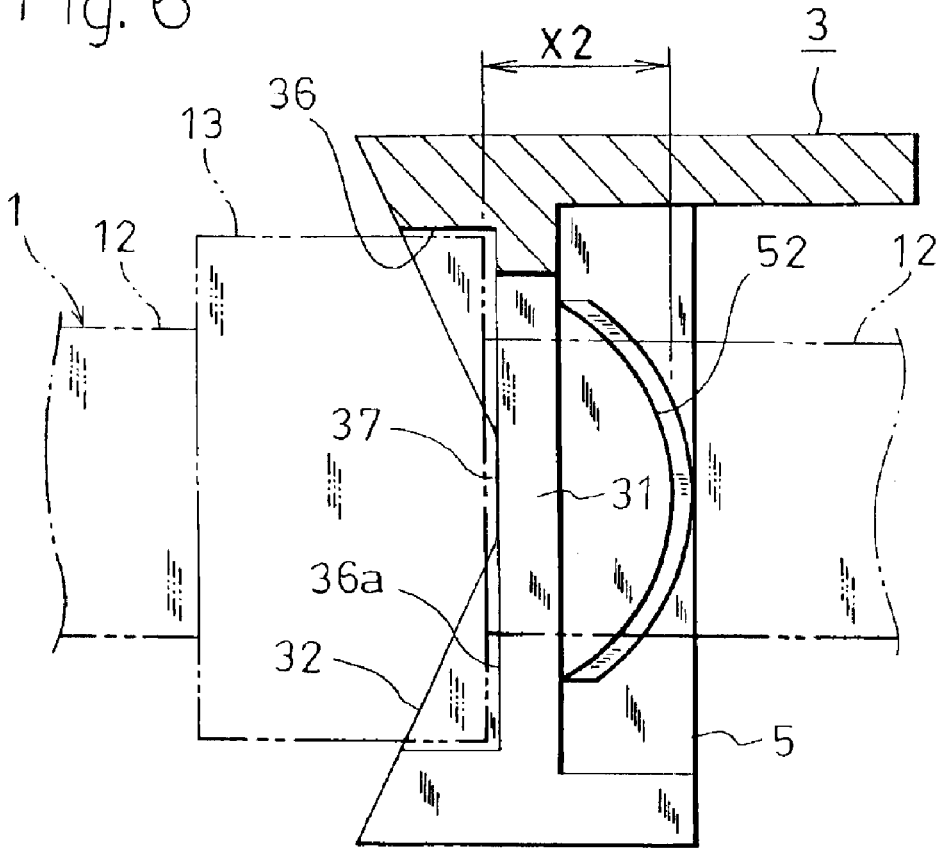
FIG. 6 is a diagram illustrating the function of a binding device of a second embodiment in which the mouthpiece of FIG. 5 is used.

FIG. 5 is a schematic perspective view of another mouthpiece 3 which is useful in the binding device of the invention, and FIG. 6 is a diagram illustrating the function of a binding device of a second embodiment in which the mouthpiece 3 of FIG. 5 is used. Hereinafter, the embodiment of the invention in which the mouthpiece 3 of FIG. 5 is used will be described. In the description of the embodiment, also FIGS. 1 and 2 and other figures are referred as required.

In the mouthpiece 3 of FIG. 5, a recess 36 which laterally elongates is formed to extend in both the flat one side region 33 and the flat other side region 34 which are on the receiving face 32, the bottom face of the recess 36 is formed as an auxiliary receiving face 36*a*, and an opening 31 having a slit-like shape is formed in the bottom wall of the recess 36. In the illustrated example, a valley bottom portion 37 of the valley-like inclined face forming the receiving face 32 is flattened. The configuration other than that described above is identical with the configuration of the mouthpiece 3 which has been described with reference to FIG. 1 or 2.

In the binding device 2 in which the mouthpiece 3 of FIG. 5 is attached to the barrel portion 21, the binding work can be conducted with selectively using either of the receiving face 32 and the auxiliary receiving face 36*a* in accordance with different sizes of head portions 13 in various binding bands 1. In the case where the bound articles M is to be bound by the binding band 1 having the head portion 13 of a size which allows the portion to enter the recess 36, when the above-mentioned tightening function is exerted by the binding device 2, the head portion 13 is caused to enter the recess 36 as indicated by the phantom lines in FIG. 6, and then received by the auxiliary receiving face 36*a* to be positioned to the widthwise center portion of the receiving face 32 by the centripetal function of the receiving face 32. In the case where the bound articles M is to be bound by the binding band 1 having the head portion 13 of a size by which the portion cannot enter the recess 36, when the above-mentioned tightening function is exerted by the binding device 2, the head portion 13 is received by the receiving face 32 without entering the recess 36, and then positioned to the widthwise center portion of the receiving face 32 by the centripetal function of the receiving face 32. The other function is identical with that of the mouthpiece 3 which has been described with reference to FIG. 1 or 2.

In the binding device 2 using the mouthpiece 3 which has been described with reference to FIG. 1, as shown in FIG. 3, the distance X1 between the end face of the head portion 13 which is received by the receiving face 32 and the cut end of the band portion 12 is correctly defined by the distance between the place for receiving the head portion 13 in the receiving face 32 and the blade edge 52 of the cutting blade 5. Therefore, the distance between the place for receiving the head portion 13 in the receiving face 32 and the blade edge 52 of the cutting blade 5 is correctly reflected to the distance X1 between the end face of the head portion 13 and the cut end of the band portion 12. Similarly, in the binding device using the mouthpiece 3 which has been described with reference to FIG. 5, when the binding band 1 having the head portion 13 of a size which allows the portion to enter the recess 36 is handled, as shown in FIG. 6, the distance X2 between the end face of the head portion 13 which is received by the auxiliary receiving face 36*a* and the cut end of the band portion 12 is correctly defined by the distance between the place for receiving the head portion 13 in the auxiliary receiving face 36*a* and the blade edge 52 of the cutting blade 5. Therefore, the distance between the place for receiving the head portion 13 in the auxiliary receiving face 36*a* and the blade edge 52 of the cutting blade 5 is correctly reflected to the distance X2 between the end face of the head portion 13 and the cut end of the band portion 12.

The distance X1 or X2 between the end face of the head portion 13 and the cut end of the band portion 12 can be changed by changing the distance between the place for receiving the head portion 13 in the receiving face 32 and the blade edge 52 of the cutting blade 5 in the case of the mouthpiece 3 which has been described with reference to FIG. 1, or by changing the distance between the place for receiving the head portion 13 in the auxiliary receiving face 36*a* and the blade edge 52 of the cutting blade 5 in the case of the mouthpiece 3 which has been described with reference to FIG. 5.

In FIGS. 1 to 15, in order to simplify the description, the identical or corresponding components are denoted by the same reference numerals.

The invention can be embodied in various other manners without departing the spirit or principal features of the invention. The embodiment described above is a mere exemplification in every respect, and is not restrictively construed. The scope of the invention is to be determined solely by the appended claims, and not limited by the description of the specification. All modifications and changes belonging to the range of equivalence of the appended claims are within the scope of the invention.

The entire disclosure of Japanese Patent Application No. 2002-011270 filed on Jan. 21, 2002 including specification, claims, drawings and summary are incorporated herein by reference in its entirety.

What is claimed is:

1. A binding device serving a tightening function for a binding band having a band portion and a head portion with a band insertion hole portion into which said band portion is insertable, and from which the band portion is disabled to be pulled back in a counter insertion direction, pulling out said band portion from said band insertion hole portion in a pulling-out direction, said band portion serving to tighten bound articles around which said band portion is wound, said bind device having: a cutting blade moved in a rear side of a mouthpiece to cross a slit-like opening; and a blade edge of said cutting blade formed into an arcuate shape in which said arcuate shape of said edges having a place that is closer to a center portion in the width direction is positioned more forward in the pulling-out direction, wherein:

said cutting blade cutting away an extra part of said band portion pulled out from said band insertion hole, said tightening function being performed, under a state where said head portion is received by a receiving face formed in a front end face of the mouthpiece, causing a clamp mechanism to grasp the extra part of said band portion passed through the slit-like opening of said mouthpiece, and then pulling out said extra part in the pulling-out direction, and said receiving face of said mouthpiece is formed by an inclined face in which by said inclined face of said receiving face a place that is closed to a center portion in the width direction is positioned more forward in said pulling-out direction, and which has slipperiness with respect to said head portion.

2. A binding device according to claim 1, wherein: said inclined face forming said receiving face is formed into a valley-like space in which a flat one side region and a flat other side region are equal to each other in opening angle with respect to a central axis that passes said center portion of said receiving face, and that elongates in parallel with said pulling-out direction said one side region and said other side region being positioned across said central axis.

3. A binding device according to claim 2, wherein a distance between an end face of said head portion which is received by said receiving face and said cut end of said band portion is defined by a distance between a place for receiving said head portion in said receiving face and said blade edge of said cutting blade.

4. A binding device according to claim 2, wherein a recess which receives said head portion to position said head portion in said widthwise center portion of said receiving face is formed to extend in both said one side region and said other side region of said receiving face, and a bottom face of said recess is formed as an auxiliary receiving face which receives said head portion.

5. A binding device according to claim 4, wherein: a distance between said end face of said head portion which is received by said auxiliary receiving face and said cut end of said band portion is defined by a distance between a place for receiving said head portion in said auxiliary receiving face and said blade edge of said cutting blade.

6. A binding device according to claim 1, wherein: a distance between an end face of said head portion which is received by said receiving face and said cut end of said band portion is defined by a distance between a place for receiving said head portion in said receiving face and said blade edge of said cutting blade.

7. A bind device according to claim 1, wherein: a recess which receives said head portion to position said head portion in said widthwise center portion of said receiving face is formed to extend in both said one side region and said other side region of said receiving face, and a bottom face of said recess is formed as an auxiliary receiving face which receives said head portions.

8. A binding device according to claim 7, wherein: a distance between said end face of said head portion which is received by said auxiliary receiving face and said cut end of said band portion is defined by a distance between a place for receiving said head portion in said auxiliary receiving face and said blade edge of said cutting blade.

* * * * *

UNITED STATES PATENT AND TRADEMARK OFFICE

CERTIFICATE OF CORRECTION

PATENT NO. : 6,926,045 B2
DATED : August 9, 2005
INVENTOR(S) : Miyazaki et al.

It is certified that error appears in the above-identified patent and that said Letters Patent is hereby corrected as shown below:

Column 10,
Line 60, “bind” should be -- binding --.

Signed and Sealed this

Eighteenth Day of April, 2006

JON W. DUDAS
*Director of the United States Patent and Trademark Office*